United States Patent [19]

Hall

[11] Patent Number: 4,570,845

[45] Date of Patent: Feb. 18, 1986

[54] CARTON CLOSURE RELEASABLE BY DEFORMATION

[75] Inventor: Charles J. Hall, Brampton, Canada

[73] Assignee: Dixie Canada Inc., Ontario, Canada

[21] Appl. No.: 674,422

[22] Filed: Nov. 23, 1984

[51] Int. Cl.[4] ..... B65D 5/22

[52] U.S. Cl. ..... 229/33; 229/35; 229/36; 229/45 R

[58] Field of Search ..... 229/2.5 R, 32, 33, 35, 229/36, 44 R, 45 R

[56] References Cited

U.S. PATENT DOCUMENTS

| | | | |
|---|---|---|---|
| 2,654,526 | 10/1953 | McReary | 229/33 |
| 2,839,236 | 6/1958 | Dunning | 229/33 |
| 3,095,137 | 6/1963 | Reynolds | 229/45 |
| 3,105,626 | 10/1963 | McCormick et al. | 229/33 |
| 3,166,230 | 1/1965 | Engstrom | 229/33 |
| 3,684,159 | 8/1972 | Wolfe | 229/45 |
| 3,809,305 | 5/1974 | Persson | 229/45 |
| 3,942,712 | 3/1976 | Bundy et al. | 229/45 |
| 4,018,378 | 4/1977 | Persson | 229/36 |
| 4,232,816 | 11/1980 | Johnson et al. | 229/33 |
| 4,266,713 | 3/1981 | Maroszek | 229/36 |
| 4,298,133 | 11/1981 | Davis | 229/2.5 R |
| 4,339,068 | 7/1982 | Brauner | 229/44 R |
| 4,360,147 | 11/1982 | Brauner | 229/36 |

*Primary Examiner*—Joseph Man-Fu Moy
*Assistant Examiner*—David T. Fidei
*Attorney, Agent, or Firm*—Sim & McBurney

[57] ABSTRACT

A box includes a base portion and a lid portion. The base portion has at least two lateral panels which are joined together at an angled corner, and a recess is provided between the lateral panels at the corner. The lid portion includes a closure panel from which a locking tab extends, the locking tab being adapted to engage the recess when the lid portion is closed against the base portion. The closure panel is capable of curvilinear deformation by finger pressure, so that the locking tab can be withdrawn from engagement in the recess, thus permitting the box to be opened.

8 Claims, 5 Drawing Figures

FIG. 1
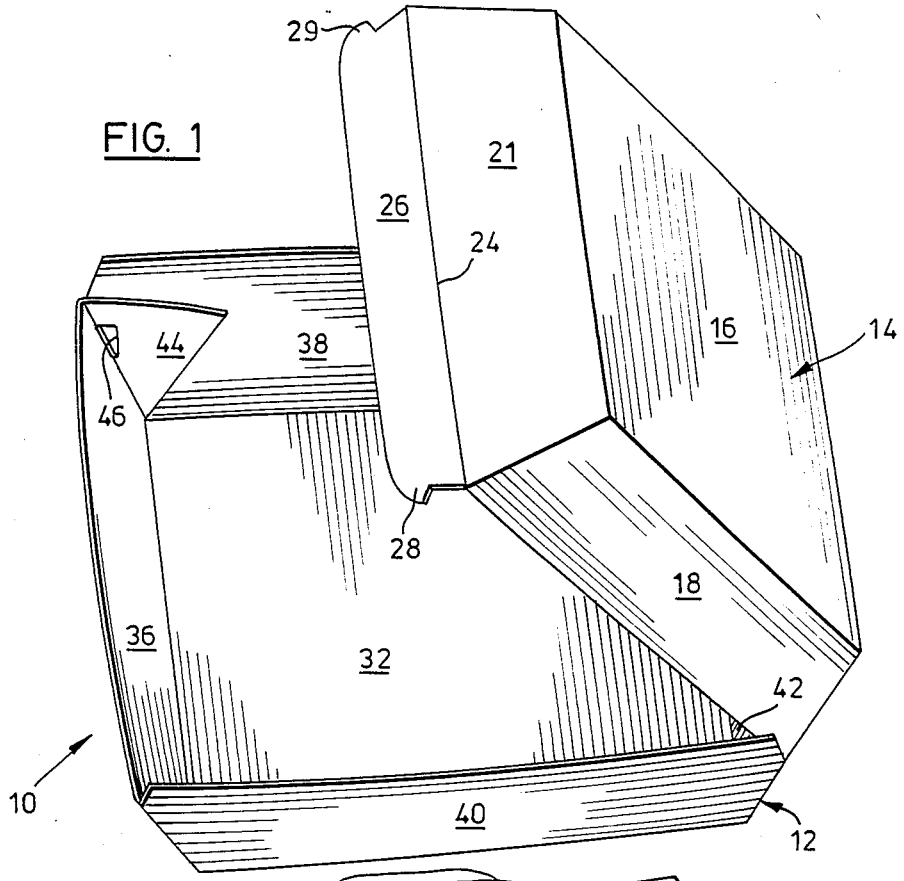
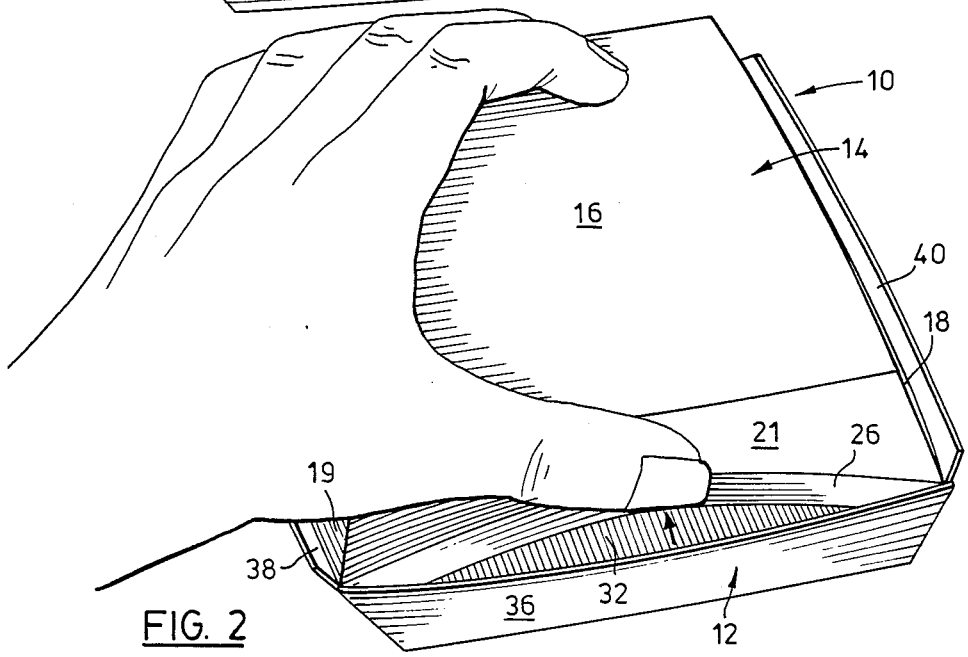
FIG. 2

CARTON CLOSURE RELEASABLE BY DEFORMATION

This invention relates generally to box constructions, and has to do particularly with a construction of a foldable box adapted to be stamped out of cardboard or like material, which when set up and appropriately glued together, provides a base container portion and a hinged lid portion. The boxes provided herein are suitable for containing food such as hamburgers, hotdogs and the like, but are not limited to that use.

BACKGROUND OF THIS INVENTION

Currently, foldable cardboard containers used in the fast-food industry for hotdogs, hamburgers and the like are of a kind which are difficult for the serving persons to close and lock together once the food has been inserted. Further, such conventional containers are particularly difficult to open again after they have been closed, in such a manner as to preserve the locking mechanism intact. While this does not present a problem to the customer, who merely wishes to open the box and does not expect to re-use it, it does present a problem to the person serving the food who may have placed the hotdog, hamburger etc. inside the package and closed it, before remembering that some additional garnish was desired by the customer. The box must then be re-opened, the garnish added, and the box closed again. With conventional boxes, the closure mechanism is destroyed or torn upon the first re-opening, and it must be discarded and replaced by a new box.

GENERAL DESCRIPTION OF THIS INVENTION

Accordingly, it is an object of an aspect of this invention to provide a box construction in which the closure between a lid portion and a base portion is easily established, and just as easily released without damaging the closure components in any way.

More particularly, this invention provides a box comprising a base portion and a lid portion. The base portion has a front panel and two side panels each joined with the front panel at an angled corner, and recess means between the front panel and each side panel at the respective corners. The lid portion has a normally flat front panel from which two locking tabs extend in the plane of the panel and constitute extensions of the panel in opposed directions, each tab being adapted to engage in a respective recess means when the lid portion is closed against the base portion. The front panel of the lid portion is resiliently deformable by finger pressure applied between the tabs, to assume a curved shape in which the direct distance between the tabs decreases, thereby withdrawing the tabs from engagement in the recess means.

GENERAL DESCRIPTION OF THE DRAWINGS

One embodiment of this invention is illustrated in the accompanying drawings, in which like numerals denote like parts throughout the several views, and in which:

FIG. 1 is a perspective view, taken obliquely from above, of a box construction embodying this invention;

FIG. 2 is another perspective view, showing the box in a position in which the lid is being released from the base portion;

DETAILED DESCRIPTION OF THE DRAWINGS

Figure 3:
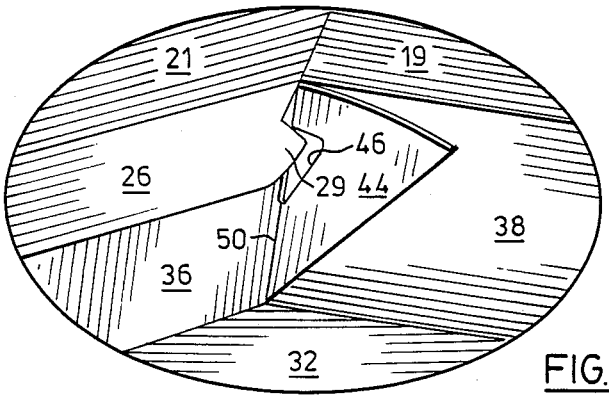
FIGS. 3 and 4 are sequential perspective views, taken from "inside" the closed box, showing the method of release.

Attention is first directed to FIG. 1, which shows a box 10 which includes a base portion 12 and a lid portion 14. The lid portion 14 includes a top panel 16 of substantially rectangular configuration, from which downwardly and divergingly extend a rear panel (not visible in FIG. 1), two side panels 18 and 19 (side panel 19 is visible in FIG. 2), and a forward panel 21. Attached to the forward panel 21 along a creased hinge line 24 is a front panel 26 from which laterally extend two locking tabs 28 and 29.

The base portion 12 has a bottom panel 32 of substantially rectangular configuration, from which upwardly and divergingly extend a front panel 36, two side panels 38 and 40 and a rear panel 42.

Figure 4:
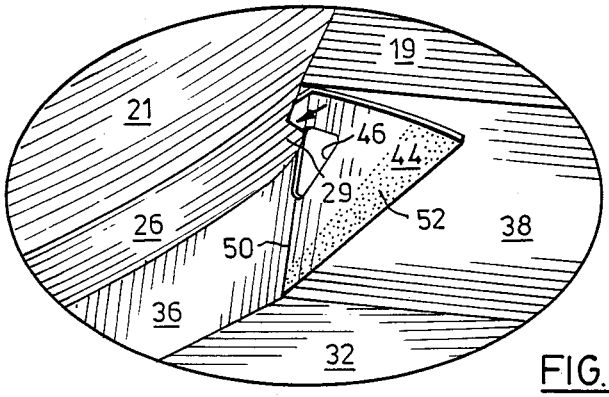

As best seen in FIGS. 1, 3 and 4, the front panel 36 of the base portion 12 has two glue flaps of which only one is visible in the figures at 44. In the embodiment illustrated, the glue flap 44 is shown to be triangular, although this is not considered a limiting configuration. Each glue flap 44 has an opening 46 adjacent its connection to the front panel 36, the opening constituting a recess within which the respective one of the locking tabs 28, 29 can lodge when the lid portion 14 is closed against the base portion 12. At least the forward panel 21 and the front panel 26 of the lid portion 14, and preferably the entirety of the box 10, are constructed of a resiliently deformable material like cardboard such that finger or thumb pressure applied approximately centrally to these panels between the locations of the tabs 28 and 29 will cause the panels to assume a curved shape such as that shown in FIG. 2, in which the direct distance between the tabs 28 and 29 decreases, thereby withdrawing them inwardly from engagement with the openings 46. As can seen by inspecting FIG. 2, the hand of the user, while pushing inwardly with the thumb in order to withdraw the tabs 28 and 29 from engagement with the openings 46, is also in a position to lift upwardly on the lid portion 14, thus opening the box and revealing the contents.

Figure 5:
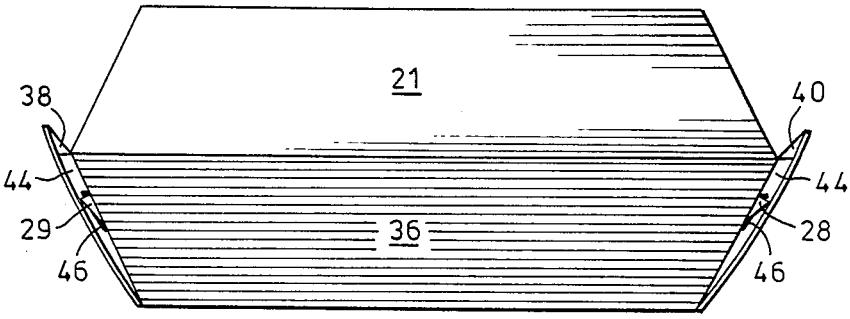
FIG. 5 is a front elevational view of the box when closed.

As can be seen in FIGS. 3 and 4, the embodiment illustrated is one in which the opening 46 is cut into the glue flap 44 entirely to one side of the crease line 50 joining the glue flap 44 to the front panel 36. With this configuration, if the side panel 38 completely overlies the opening 46 (as may be desired for aesthetic reasons), it will be evident that, for proper functioning, the side panel 38 should not be directly adhered to the glue flap 44 immediately adjacent the opening 46. If this were to take place, then in would be difficult or impossible for the respective locking tab 28, 29 to properly engage in the opening 46. By adhering the glue flap 44 to the side panel 38 only at an area remote from the opening 46, for example in the area 52 which has been stippled in FIG. 4, it is possible for the side panel 38 to resiliently deform outwardly away from the glue flap 44 under pressure from the respective locking tab 28, 29. This is the condition illustrated in FIG. 5, where the side panel 38 (at the left of FIG. 5) is shown to be somewhat outwardly displaced from the front panel 36, due to pressure from the locking tab 29. The same situation takes place at the righthand side of FIG. 5.

While one embodiment of this invention has been illustrated in the accompanying drawings and described hereinabove, it will be evident to those skilled in the art that changes and modifications may be made therein, without departing from the essence of this invention as set forth in the appended claims.

I claim:

1. A box comprising:

a base portion having a front panel and two side panels each joined with the front panel at an angled corner, and recess means between the front panel and each side panel at the respective corners, and a lid portion having a normally flat front panel from which two locking tabs extend in the plane of the panel and constitute extensions of the panel in opposed directions, each tab being adapted to engage in a respective recess means when the lid portion is closed against the base portion, said front panel of said lid portion being resiliently deformable by finger pressure applied between the tabs, to assume a curved shape in which the direct distance between the tabs decreases, thereby withdrawing the tabs from engagement in the recess means.

2. The box claimed in claim 1, in which the box is of cardboard, and each recess means is an aperture.

3. The box claimed in claim 1, in which the front panel of the base portion has two glue flaps, each glue flap being adhered to one of the two side panels, each glue flap having an opening adjacent its connection to the front panel, the openings constituting the respective recess means.

4. The box claimed in claim 3, in which each glue flap is adhered to its respective side panel at a region of the glue flap which is remote from the opening therein.

5. The box claimed in claim 1, in which the lid portion has a top panel of substantially rectangular configuration, from which extend a rear panel, two side panels and a forward panel, said front panel of the lid portion being hingedly attached to said forward panel; and in which the base portion has a bottom panel of substantially rectangular configuration, from which upwardly extend said front panel of said base portion, said side panels and a rear panel.

6. The box claimed in claim 4, in which the lid portion has a top panel of substantially rectangular configuration, from which extend a rear panel, two side panels and a forward panel, said front panel of the lid portion being hingedly attached to said forward panel; and in which the base portion has a bottom panel of substantially rectangular configuration, from which upwardly extend said front panel of said base portion, said side panels and a rear panel.

7. The box claimed in claim 6, in which the box is of cardboard.

8. The box claimed in claim 5, in which the rear, side and forward panels of the lid portion diverge downwardly, and in which the front, side and rear panels of the base portion diverge upwardly.

* * * * *